United States Patent [19]

Maucher et al.

[11] 4,347,813

[45] Sep. 7, 1982

[54] APPARATUS FOR STARTING AN INTERNAL COMBUSTION ENGINE

[75] Inventors: Paul Maucher, Sasbach; Hugo-Werner Geschka, Düsseldorf, both of Fed. Rep. of Germany

[73] Assignee: Luk Lamellen und Kupplungsbau GmbH, Bühl, Fed. Rep. of Germany

[21] Appl. No.: 101,547

[22] Filed: Dec. 7, 1979

[30] Foreign Application Priority Data

Dec. 8, 1978 [DE] Fed. Rep. of Germany ..... 2853130

[51] Int. Cl.[3] ..... F02N 5/04

[52] U.S. Cl. ..... 123/179 J; 123/179 F; 123/179 M

[58] Field of Search ..... 123/179 F, 179 J, 179 M, 123/179 R

[56] References Cited

U.S. PATENT DOCUMENTS

| | | | |
|---|---|---|---|
| 1,257,428 | 2/1918 | Vincent | 123/179 M |
| 1,744,868 | 1/1930 | Cox | 123/179 M |
| 2,338,403 | 1/1944 | Callsen | 123/179 J |
| 2,531,788 | 11/1950 | Ricardo | 123/179 J |
| 2,715,396 | 8/1955 | Silberstein | 123/179 J |
| 2,877,755 | 3/1959 | Danilewicz | 123/179 J |
| 3,182,650 | 5/1965 | Heckt | 123/179 F |
| 3,465,353 | 9/1969 | Buxton et al. | 123/179 M |
| 3,811,281 | 5/1974 | Wise et al. | 123/179 F |
| 3,882,950 | 5/1975 | Strohlein | 123/179 J |

FOREIGN PATENT DOCUMENTS

| | | | |
|---|---|---|---|
| 608318 | 9/1948 | United Kingdom | 123/179 J |

*Primary Examiner*—Charles J. Myhre
*Assistant Examiner*—Andrew M. Dolinar
*Attorney, Agent, or Firm*—Kontler, Grimes & Battersby

[57] ABSTRACT

Apparatus for starting an internal combustion engine, including a starter wheel for driving the engine, pressure medium activated means for causing the starter wheel to drive the engine, a pump for the pressure medium, and a common motor for driving the pump and starter wheel.

20 Claims, 3 Drawing Figures

APPARATUS FOR STARTING AN INTERNAL COMBUSTION ENGINE

The invention relates to an apparatus for starting an internal combustion engine, comprising at least one component or pressure means which is activated by pressure medium.

Internal combustion engines and devices driven by internal combustion engines, such as motor vehicles or stationary machines, for example, have been known wherein the fuel is transported by pressure driven pumps. In many cases there is a pressure storage tank provided through which the vacuum pump or low pressure pump can be supplied for transporting the fuel required for starting. However, the starting operation can be made difficult or impossible if the negative pressure system in such devices is defective, so that no negative pressure, or only an insufficient amount thereof exists.

It is accordingly an object of the invention to provide an apparatus for starting an internal combustion engine which overcomes the hereinafore mentioned disadvantages of the heretofore known devices of this general type, and to assure in a particularly simple manner that pressure, and negative pressure, respectively, is generated to operate, or to drive the components by which the starting process is initiated, or made possible.

With the foregoing and other objects in view there is provided in accordance with the invention, an apparatus for starting an internal combustion engine, comprising a starter wheel for driving the engine, pressure medium activated means for causing the starter wheel to drive the engine, a pump for the pressure medium, and a common motor for driving the pump and starter wheel.

In accordance with another feature of the invention there is provided on the engine a flywheel which is to be accelerated by the starter wheel to a given rotary speed, and a pressure operated clutch for bringing the flywheel into engagement with the engine.

In this way, the drive of the negative pressure motor for transporting the fuel can be in direct rotating connection with the internal combustion engine during the operation of the latter.

In accordance with a further feature of the invention, there are provided control means for driving the pump when the motor is switched on and standing still during the starting phase and for causing the starter wheel to drive the flywheel after a given pressure in the medium has been reached.

In accordance with an added feature of the invention, there are provided means for selectively operating the pump and starter wheel on demand.

In accordance with an additional feature of the invention, there are provided means for interrupting the drive between the starter wheel and the pump.

In accordance with yet another feature of the invention, the interrupting means are pressure activated.

In accordance with yet a further feature of the invention, the interrupting means is a pressure monitor.

In accordance with yet an added feature of the invention, the interrupting means are activated in dependence on the disengaged condition of the clutch.

Furthermore, the invention can also be used for generating pressure or vacuum, for example, in order to operate (adjust) the injection pump for starting a diesel engine.

A particularly advantageous further development of the invention relates to a system for operating an internal combustion engine which is described in the commonly owned copending allowed patent application Ser. No. 046,056 filed June 6, 1979 now U.S. Pat. No. 4,317,435 by Ernst-Hermann Kohlhage. According to the invention of Kohlhage, there is provided a flywheel which can be accelerated to a required number of revolutions per minute for starting by a starter wheel—possibly in form of a friction wheel—, and which can be coupled to the engine by a pressure-activated clutch, or particularly by a vacuum operated clutch, and wherein there is provided a pump, particularly a negative pressure generating pump, and wherein a common drive motor is used for the pump and the starter wheel.

The apparatus can also be constructed so that in dependence on a control device, after turning on the starting motor, first the pump, and then, after reaching a predetermined pressure, and a predetermined vacuum, the starter wheel for driving the flywheel is driven. However, if necessary, the starter wheel or the pump can be made operable. Accordingly, in accordance with yet an additional feature of the invention there are provided control means for maintaining the starter wheel out of engagement with the flywheel and/or for shifting the starter wheel into engagement with the flywheel.

Furthermore the arrangement can be so controlled that it is possible to interrupt the drive connection between the pump and the drive motor. The interruption and the re-connecting, respectively, of the pump drive can be controlled in a particularly simple manner by a pressure monitor. Therefore, in accordance with still another feature of the invention, the control means are pressure activated.

The interruption of the drive of the pump can also be effected in dependence on the condition of disengagement of the clutch; in motor vehicles particularly it can be effected in dependence on the conditioning disengagement of the clutch for disengaging the flywheel, and also in dependence on the disengagement of another clutch, particularly the clutch for the drive gears.

It is advantageous if there are means provided for holding the starter wheel back in a non-engaged position with respect to the flywheel, up to the moment when the flywheel must be driven. These retaining means may be pneumatically controlled, for example, and release the starter wheel when the required vacuum is present and/or the clutch, or the clutches, is or are engaged. Therefore, in accordance with still a further feature of the invention, the control means are activated in dependence on the disengaged condition of the clutch.

In accordance with still an added feature of the invention, the operating means are pressure activated.

In the same manner that the drive connection between pump and starting motor can be interrupted, also the drive connection between starter-wheel and starting motor can be interrupted, so that only the power for the one respective component is required, and idling losses of the other component are avoided.

It is particularly advantageous if the drive for the pump or for the starter is controlled according to existing need, so that the pump is only operated if there is no vacuum, or only until the required pressure—respectively negative pressure level is achieved. But the "by need" controlled drive for the pump or for the starter wheel can also be provided, in accordance with still an additional feature of the invention by linkage means for engaging the clutch and means for controlling the driving of the pump and starter wheel in dependence on the position of the linkage means.

In accordance with another feature of the invention, and particularly in motor vehicles, the clutch is a shift clutch, and includes drive gearing for the engine, another shift clutch for driving the drive gearing, and means for driving the starter wheel and pump in dependence on the condition of disengagement of the clutches.

In accordance with a further feature of the invention, the pump is integral with the motor.

In accordance with an added feature of the invention, the control means are integral with the motor.

In accordance with an additional feature of the invention, the control means are operable to retract the starter wheel from the flywheel, in order to protect the starting motor or the starting wheel, particularly a friction wheel, from damage. Furthermore in these cases, the slip clutch or free wheeling device which is otherwise required in starters, is not required.

In accordance with yet another feature of the invention, the control means are controllable in dependence on the energy stored in the flywheel and/or in dependence on the rotary speed of the flywheel and/or in dependence on the engagement position of the clutch.

In accordance with yet a further feature of the invention, the direction of rotation of the motor is reversible.

In accordance with yet an added feature of the invention, the motor drives the pump in one direction of rotation thereof and engages the starter wheel with the flywheel in the other direction of rotation thereof.

In accordance with yet an additional feature of the invention, there are provided threaded drive means with a coarse screw thread disposed between the motor and starter wheel for maintaining the starter wheel out of engagement with the flywheel when the motor rotates in the one direction of rotation for driving the pump. In this case, no shift or control means are required for holding back the starter wheel. If the direction of rotation is reversed, or if the starting motor immediately turns in the direction in which it drives the flywheel, the starter wheel is moved by the coarse thread in the axial direction so that for this mode of operation, no shift or control means are required either, in order to bring the starter wheel, which may be in the form of a friction wheel, into engagement with its mating inertial flywheel.

In accordance with still another feature of the invention, there is provided a slip clutch disposed between the motor and the pump for disengaging the drive for the pump when the motor rotates in the other direction of rotation for engaging the starter wheel with the flywheel.

In accordance with still a further feature of the invention, there are provided a drive shaft for the pump, an axial cam disc or eccentric disposed on the drive shaft for driving the pump and a slip clutch or free-wheeling means for causing the cam disc to drive the pump as soon as the motor rotates in the one direction of rotation for driving the pump.

In accordance with still an added feature of the invention, there are provided means for selecting the direction of rotation of the motor in dependence on the pressure of the medium and/or in dependence on the condition of disengagement of the clutch or clutches.

In accordance with still an additional feature of the invention, the motor is a d-c shunt motor.

In accordance with another feature of the invention, the direction of rotation of the motor is reversed by reversing the current fed thereto.

In accordance with a further feature of the invention, there are provided a circuit for supplying current to the motor and a reversing switch disposed in the circuit for reversing the current feed.

In accordance with an added feature of the invention, the reversing switch is a double pole switch which is reversed or activated in dependence on the pressure or vacuum, and/or the disengagement position of the clutch or clutches.

In accordance with an additional feature of the invention, there are provided means for regulating the speed of rotation of the motor.

In accordance with yet another feature of the invention, the regulating means are controlled in dependence on factors which influence the starting of the engine.

In accordance with yet an added feature of the invention, the factors are at least one of the air and water and oil temperature in the engine or other criteria, so that under unfavorable starting conditions, i.e. great cold, a reliable start of the internal combustion engine will also be effected.

In accordance with yet an additional feature of the invention, the regulating means are infinitely adjustable.

In accordance with still another feature of the invention, the regulating means are adjustable stepwise.

In accordance with a concomitant feature of the invention, the regulating means includes a resistor, such as a variable resistor, shunted or bridged across the motor.

Other features which are considered as characteristic for the invention are set forth in the appended claims.

The invention is not intended to be limited to the details shown, since various modifications and structural changes may be made therein without departing from the spirit of the invention and from the scope and range of equivalents of the claims.

The construction and mode of operation of the apparatus, however, together with additional features and advantages thereof, will be best understood from the following description of specific embodiments when read in connection with the accompanying drawings, in which.

Figure 1:
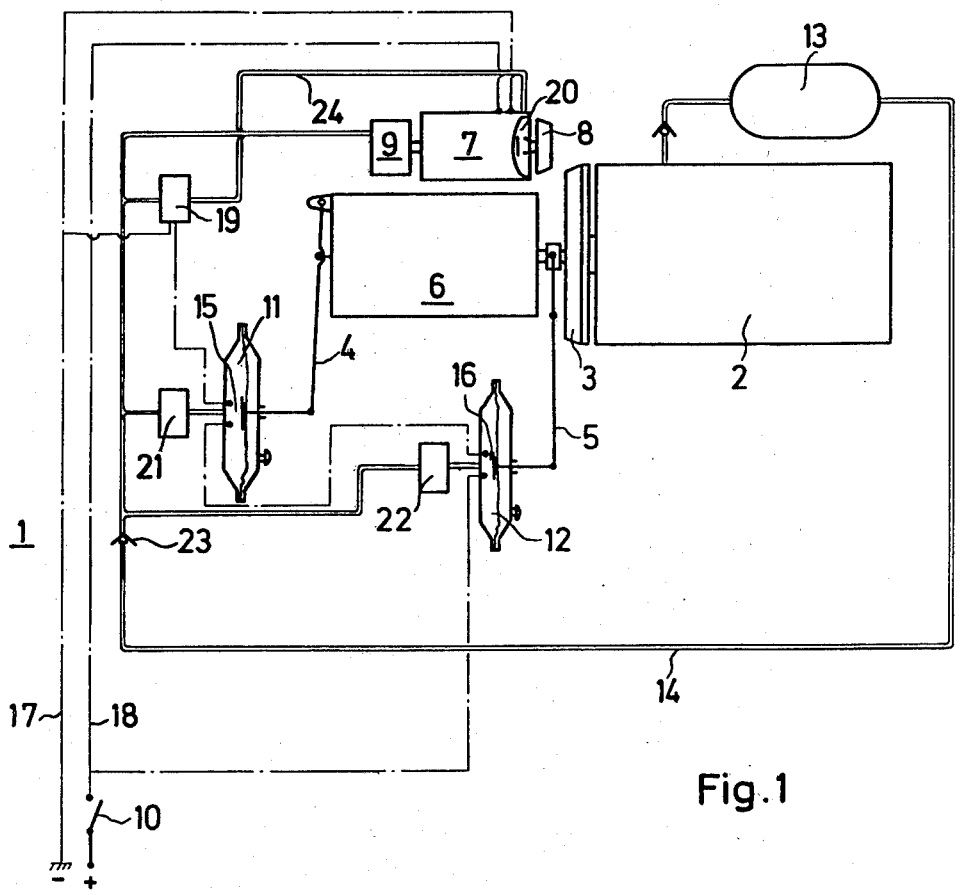
FIG. 1 is a diagrammatic view of an apparatus for starting a combustion engine, with its control and regulating elements.

Referring to FIG. 1, there is shown an apparatus 1 for starting an internal combustion engine 2 through the use of a flywheel 3 which can be driven by a first clutch through a linkage 4, and coupled to or disconnected from the combustion engine 2; the clutch itself is not shown in detail. The gearing 6 of the combustion engine 2 can be coupled or disconnected by a second clutch through the linkage 5.

Furthermore, the apparatus 1 comprises an electric motor 7 which is operable to drive a starter wheel 8 and/or a pump 9 when the contact 10 is closed, for example by an ignition key.

In order to start the internal combustion engine 2, both clutches must be disengaged, so that the flywheel 3 can be brought to the required number of revolutions by the starter wheel 8. After the flywheel 3 reaches the required speed, the first clutch is engaged through the linkage 4, the mass of the flywheel 3 is coupled to the crankshaft of the internal combustion engine 2, and the internal combustion engine is turned over or started.

In FIG. 1, there are also shown pneumatic actuators 11, 12 which can usually be supplied with negative pressure from the negative pressure or storage tank 13 via supply line 14. In the position corresponding to the disengaged state of the clutches, the membranes of the actuators 11, 12 complete the electric circuit 17, 18, for the starting motor 7 through contact bridges 15, 16. Consequently, the line 18 is bridged to the line 17 over the dot-dash line extending through the contact bridges 15, 16 and a magnetic valve 19. Simultaneously, magnetic valve 19 is also activated, whereby a control device 20 is supplied with negative pressure. The control device 20 is operable to shift the starter wheel 8 into, or retain the starter wheel out of, engagement with the flywheel 3. This control device 20 can function as means for holding back the starter of friction wheel 8, or as a means to release, or means to engage the latter, as will be further explained hereinbelow in connection with FIG. 2. Through the action of the control device 20 the friction wheel 8 is moved in the axial direction toward the friction surface of the flywheel 3, and the drive motor 7 drives the flywheel 3 to a predetermined number of revolutions per minute or speed. After reaching the required speed and depending on: the number of revolutions of the flywheel 3; on an ignition current of the internal combustion engine; on the number of revolutions of the motor 7; on the negative (vacuum) pressure generated by the internal combustion engine (particularly in gasoline engines); on the driving conditions and the use of motor vehicles; on the temperature of certain media and on other criteria; the contact 15 is positioned by means of a valve 21 so that the linkage 4 engages the flywheel 3 of the internal combustion engine, and starts the latter. However, this valve 21 can also be activated dependent on the opening of the switch 10 if the ignition key is turned back to its original position, and therefore the starting of the motor or engine is effected. A control valve 22 causes the selective, and controlled operation of the gearshift clutch by the linkage 5, and can be controlled dependent on the same criteria as the valve 21.

While the motor 7 is running, the vacuum or negative pressure system can additionally be supplied with negative pressure by the pump 9, for example at times when the vacuum is not sufficient. However, the vacuum pump 9 can also be stopped when the friction wheel 8 drives the flywheel 3, either by being controlled by pressure or vacuum, or in dependence on the condition of disengagement of the clutches.

If an insufficient vacuum exists in the system when the switch 10 for starting the engine is operated, then the circuit of the valve 19 will be interrupted, so that the hold-back and operating or releasing control device 20 in the motor 7 holds the friction wheel 8 in the illustrated position, i.e., at a distance from the flywheel 3. The starting motor 7 is energized by the switch 10, and operates the pump 9, so that the contacts 15 and 16 disengage the clutches through the corresponding linkages 4 and 5. Because of provision of a check valve 23, the whole vacuum system of the apparatus 1 need not be supplied with negative pressure up to the motor or engine 2, but only the directly affected actuators 11 and 12. This results in rapid disengagement of the clutches, and simultaneously in rapid closing of the circuit through the contacts 15, 16.

When the contacts 15 and 16 are closed, the two clutches are in the disengaged state, and the valve 19 is activated and causes the friction wheel 8 to move axially toward the complementary friction surface of the flywheel 3. This will be further explained hereinbelow in connection with FIG. 2.

Figure 2:
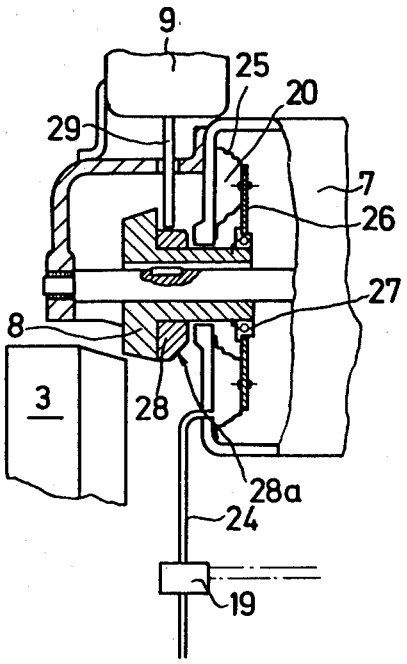
FIG. 2 is a diagrammatic partly cross sectional fragmentary view of the means for operating a pump and a starter wheel with a common or shared motor.

FIG. 2 shows that the starting motor 7 has the pump 9 flange-mounted thereto, including the control device 20, the starter wheel 8 and the pneumatic line 24 which connects the valve 19 with the chamber at one side of a ring membrane or diaphragm 25 of the control device 20. When the electrical circuit is closed, i.e. in the disengaged condition of the clutches, the valve 19 is activated, as already mentioned. Because of this, the diaphragm 25 is acted upon by negative pressure through the line 24, whereby the diaphragm and a setting ring 26 which is fastened thereto are moved to the left, as viewed in FIG. 2, and by way of the interposed ball bearing 27 the friction wheel 8 is also moved to the left in a direction toward the conical friction surface of the flywheel 3.

The withdrawal or retraction of the starting or friction wheel 8 and the friction wheel 3 from each other is effected by opening the contact 15 which occurs at the beginning of the engagement of the flywheel clutch that is controlled by the linkage 4. The valve 19 is thereby activated and can connect the line 24 to the atmosphere. Thereby the diaphragm 25 and with it the friction wheel 8 can again move to the right. The pump 9 is shut off after the engagement of flywheel 3 as follows:

The pump 9 is driven by an eccentric 28 and a push rod 29, as soon as, and as long as, insufficient or inadequate negative pressure or vacuum exists, and as long as the electrical circuit 17, 18 is not completed by the contacts 15, 16. As soon as the starter or friction wheel 8 is moved in the axial direction, the eccentric 28 is also axially displaced thereby, and slides away from under the push rod 29, so that in the latter position the pump 9 is not operated, and power is no longer used for driving the pump 9. When the diaphragm 25 moves the starter wheel 8 and with it the eccentric 28 to the right, as viewed in FIG. 2 the eccentric 28 can again slide under the push-rod 29 which slides over the cam face 28*a*.

Figure 3:
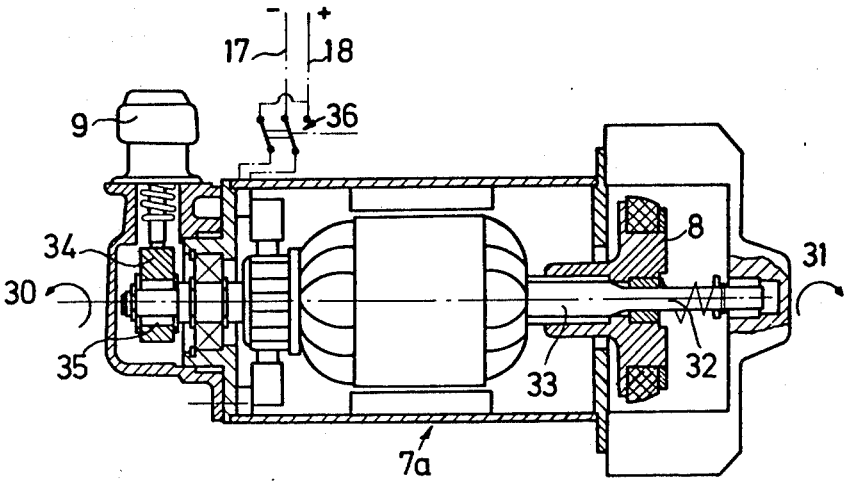
FIG. 3 is a view similar to that of FIG. 2 but showing another embodiment of the invention for operating a pump and a starter wheel with a common motor.

In FIG. 3, there is shown a motor 7*a* which is an electric motor that is capable of reversing the direction of rotation. The motor 7*a* may, for example, be a direct current shunt motor with four poles, whereby rotation to the left or counter-clockwise, as indicated by the arrow 30, is used for driving the pump 9 which is integtated in the motor 7*a*, and rotation to the right or clockwise, as indicated by the arrow 31, is used for driving the flywheel 3.

Furthermore, it can be seen in FIG. 3 that the friction wheel 8 is connected to the motor shaft 32 through a threaded drive sleeve 33. This threaded connection provides for the friction wheel 8 to move axially in the direction toward the flywheel 3 when the motor turns toward the right, and for the thread to move the wheel 8 away from the flywheel 3 during rotation to the left, so that damage to the motor and the flywheel is avoided when the motor is operated to the left, and only the pump 9 is driven. For this purpose there is provided an eccentric or cam disc 34 on the motor shaft 32, and between them there is disposed a slip clutch or free wheeling means 35. In this way, power is transmitted between the shaft 32 and the eccentric 34 only when the motor turns to the left according to arrow 30, but the pump 9 is not driven when the motor turns to the right according to arrow 31.

The direction of rotation is controlled by a switch 36, which in turn can be controlled in dependence on the existing negative pressure and/or in dependence on the disengaged condition of the two clutches.

The two electrical lines 17, 18 lead to the reversing switch 36, so that in response to closing of the switch 10 by the ignition lock, the electric motor *7a* is supplied with current. The switch 36 shown in FIG. 3 is in a state in which the two clutches are not yet disengaged, i.e., in a state when the negative pressure has not yet caused the closing of the contacts 15, 16, and in a position where the motor turns to the left, in the direction of the arrow 30. Because of the rotation to the left, the pump 9 is then operated and with closed contacts 15, 16, i.e., with disengaged clutches, the switch 36 reverses poles, so that the direction of rotation is reversed, and the motor turns in the direction of arrow 31. Thereby the friction wheel 8 is moved in axial direction and the flywheel 3 can be driven. The switch 36 can be constructed so that it is only controlled by vacuum pressure or negative pressure and at sufficient vacuum already in the position to direct, or to prepare, the motor *7a* for right-hand rotation, or to start the left-hand rotation only when the negative pressure is not sufficient.

There are claimed:

1. Apparatus for starting an internal combustion engine, comprising a starter wheel, a starter motor for rotating said starter wheel, a flywheel rotatable by said starter motor, means for reversing the direction of rotation of said starter motor, and a rotatable device connected to said starter motor, arranged so that said flywheel is rotatable when said starter motor is driven to rotate in one direction, and said device is rotatable when said starter motor is driven to rotate in the opposite direction.

2. Apparatus according to claim 1, wherein said starter motor is arranged to rotate said flywheel by way of said starter wheel and further comprising control means for disengaging said starter wheel from said flywheel.

3. Apparatus according to claim 1, wherein said starter motor is arranged to rotate said flywheel by way of said starter wheel and further comprising threaded drive means disposed between said starter motor and said starter wheel for disconnecting said starter wheel from said flywheel when said starter motor rotates in said opposite direction to drive said device.

4. Apparatus according to claim 1, further comprising freewheeling means interposed between said starter motor and said device to disconnect said device from said starter motor when said starter motor rotates in said one direction to effect rotation of said flywheel.

5. Apparatus according to claim 1, further comprising a drive shaft for said device, a cam disc disposed on said drive shaft for driving said device, and freewheeling means for causing said cam disc to drive said device when said starter motor rotates in said opposite direction to drive said device.

6. Apparatus according to claim 1, wherein said starter motor is a d-c shunt motor.

7. Apparatus according to claim 6, wherein said reversing means comprises means for reversing current fed to said motor.

8. Apparatus according to claim 7, further comprising a circuit for supplying current to said motor, said reversing means including a switch disposed in said circuit and operable to reverse the current feed.

9. Apparatus according to claim 8, wherein said switch is a double pole switch.

10. Apparatus according to claim 1, wherein said engine is a motor vehicle engine.

11. Apparatus according to claim 1, wherein said starter motor is arranged to accelerate said flywheel to a predetermined speed by way of said starter wheel and further comprising a clutch operable by pressurized fluid to connect said flywheel with the engine, said device including a pump for supplying the pressurized fluid and said starter motor constituting an electric motor.

12. Apparatus according to claim 11, further comprising control means for effecting the operation of said pump in response to starting of said motor and for causing said starter wheel to rotate said flywheel when the pressure of the fluid supplied by said pump reaches a given value.

13. Apparatus according to claim 11, further including means for selectively initiating the operation of said pump and rotation of said starter wheel on demand.

14. Apparatus according to claim 11, further comprising means for engaging said clutch and control means for effecting the operation of said pump and rotation of said starter wheel in dependency on the position of said engaging means.

15. Apparatus acccording to claim 11, wherein said clutch is a shift clutch and further comprising a drive gearing for the engine, a second clutch for driving said gearing and means for effecting the operation of said pump and rotation of said starter wheel in dependency on the condition of said clutches.

16. Apparatus according to claim 11, wherein said pump is integral with said motor.

17. Apparatus according to claim 11, wherein said flywheel is rotatable by way of said starter wheel, and further comprising control means operable to retract said starter wheel from engagement with said flywheel.

18. Apparatus according to claim 17, wherein said control means is operable as a function of the condition of said clutch.

19. Apparatus according to claim 11, further comprising means for selecting the direction of rotation of said starter motor in dependency on the pressure of the fluid.

20. Apparatus according to claim 11, wherein said clutch is a shift clutch and further comprising a drive gearing for the engine, a second clutch for driving said gearing, and means for selecting the direction of rotation of said starter motor in dependence on disengaged condition of said clutches.

* * * * *